US008681067B2

(12) United States Patent
Lee et al.

(10) Patent No.: US 8,681,067 B2
(45) Date of Patent: Mar. 25, 2014

(54) ANTENNA APPARATUS HAVING DEVICE CARRIER WITH MAGNETODIELECTRIC MATERIAL

(75) Inventors: Joong Hee Lee, Seongnam-si (KR); Jung Yub Lee, Seongnam-si (KR); Ju Hyang Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 291 days.

(21) Appl. No.: 13/192,791

(22) Filed: Jul. 28, 2011

(65) Prior Publication Data

US 2012/0038531 A1 Feb. 16, 2012

(30) Foreign Application Priority Data

Aug. 10, 2010 (KR) ..... 10-2010-0076793

(51) Int. Cl.
*H01Q 1/00* (2006.01)

(52) U.S. Cl.
USPC ..... 343/787; 343/700 MS

(58) Field of Classification Search
USPC ..... 343/787, 788, 700 MS, 702; 29/600
See application file for complete search history.

(56) References Cited

U.S. PATENT DOCUMENTS

| | | | | |
|---|---|---|---|---|
| 6,870,507 | B2 * | 3/2005 | Anguera Pros et al. | 343/700 MS |
| 7,511,675 | B2 * | 3/2009 | Puente-Baliarda et al. | 343/713 |
| 8,353,097 | B2 * | 1/2013 | Byun et al. | 29/600 |
| 2002/0163470 | A1 | 11/2002 | Nagumo et al. | |
| 2004/0001026 | A1 | 1/2004 | Killen et al. | |
| 2005/0206574 | A1 | 9/2005 | Okayama | |
| 2006/0049990 | A1 | 3/2006 | Watada et al. | |
| 2011/0025572 | A1 * | 2/2011 | Lee et al. | 343/787 |

FOREIGN PATENT DOCUMENTS

| | | | | |
|---|---|---|---|---|
| EP | 0 825 676 | A2 | 2/1998 | |
| EP | 0 924 795 | A1 | 6/1999 | |
| EP | 1 798 210 | A1 | 6/2007 | |
| EP | 1 865 573 | A1 | 12/2007 | |
| EP | 2249433 | * | 11/2010 | H01Q 1/24 |
| WO | 2011/014001 | A2 | 2/2011 | |

* cited by examiner

*Primary Examiner* — Hoang V Nguyen
(74) *Attorney, Agent, or Firm* — Jefferson IP Law, LLP

(57) ABSTRACT

An antenna apparatus having a device carrier made of a magneto-dielectric material is provided. The antenna apparatus includes a device carrier having a magnetic carrier made of a magneto-dielectric material, and an antenna device connectable to a power source through a feeding point of one end portion and extended from the feeding point to pass through a surface of the magnetic carrier and operable in a resonant frequency band when power is supplied through the feeding point. Therefore, by forming at least a portion of the device carrier with a magnetic carrier, an operating performance of the antenna apparatus can be improved.

17 Claims, 7 Drawing Sheets

ANTENNA APPARATUS HAVING DEVICE CARRIER WITH MAGNETODIELECTRIC MATERIAL

PRIORITY

This application claims the benefit under 35 U.S.C. §119(a) of a Korean patent application filed on Aug. 10, 2010 in the Korean Intellectual Property Office and assigned Serial No. 10-2010-0076793, the entire disclosure of which is hereby incorporated by reference.

BACKGROUND OF THE INVENTION

1. Field of the Invention

The present invention relates to an antenna apparatus of a communication terminal. More particularly, the present invention relates to an antenna apparatus having a device carrier made of a magneto-dielectric material.

2. Description of the Related Art

In general, a communication terminal has an antenna apparatus for transmitting/receiving an electromagnetic wave. The antenna apparatus operates in a specific resonant frequency band to transmit/receive an electromagnetic wave of a corresponding resonant frequency. In this case, when resonating in a corresponding resonant frequency band, impedance of the antenna apparatus becomes an imaginary number. In a corresponding resonant frequency band of the antenna apparatus, a parameter S rapidly changes.

To address this issue, the antenna apparatus has an electrical length of $\lambda/2$, for a wavelength $\lambda$ corresponding to a resonant frequency band, and is configured such that one end of the antenna apparatus is opened or shorted. As the antenna apparatus transmits an electromagnetic wave through a conducting wire and a standing wave is formed, a resonance occurs in the antenna apparatus. In this case, as the antenna apparatus has a plurality of conducting wires having different lengths, a resonant frequency band can be extended.

However, in an antenna apparatus, because an electrical length of a conducting wire is determined to correspond to a resonant frequency band, a size of the antenna apparatus is determined according to the resonant frequency band. Thereby, as a resonant frequency band for transmission by the antenna apparatus is lowered, a problem occurs in that the antenna apparatus becomes too large. Moreover, as the number of conducting wires increases in an antenna apparatus, the problem becomes more serious. That is, as a resonant frequency band is extended in an antenna apparatus, a problem that the antenna apparatus has a large size exists.

SUMMARY OF THE INVENTION

Aspects of the present invention are to address at least the above-mentioned problems and/or disadvantages and to provide at least the advantages described below. Accordingly, an aspect of the present invention is to provide an antenna apparatus that can extend a resonant frequency band.

Another aspect of the present invention is to provide an antenna apparatus that can decrease a size.

Another aspect of the present invention is to provide an antenna apparatus that can reduce a production cost.

In accordance with an aspect of the present invention, an antenna apparatus is provided. The antenna apparatus includes a device carrier having a magnetic carrier made of a magneto-dielectric material, and an antenna device connectable to a power source through a feeding point of one end portion and extended from the feeding point to pass through a surface of the magnetic carrier and operable in a resonant frequency band when power is supplied through the feeding point.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following detailed description in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
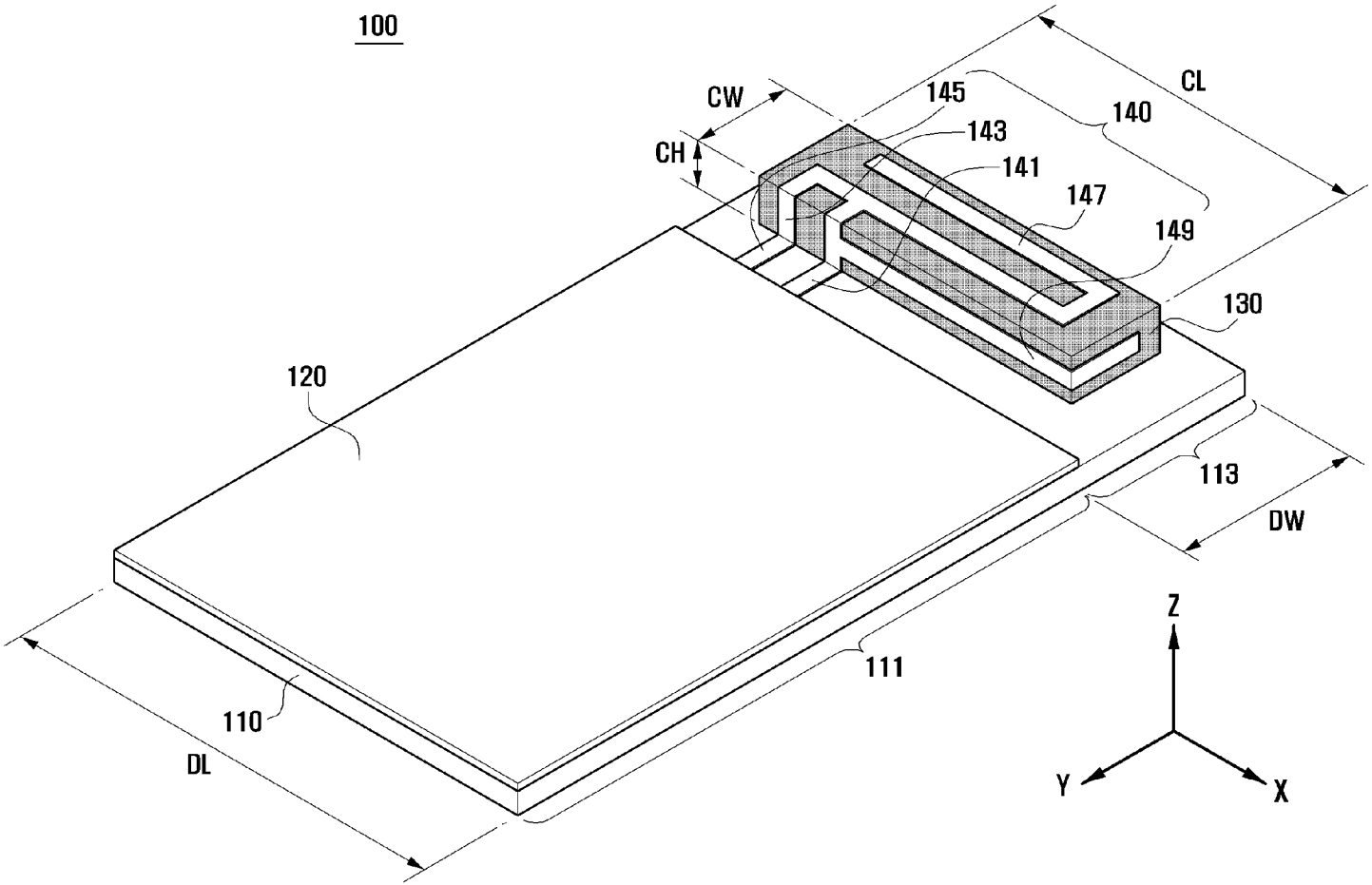
FIG. 1 is a perspective view illustrating an antenna apparatus according to a first exemplary embodiment of the present invention.
Figure 2:
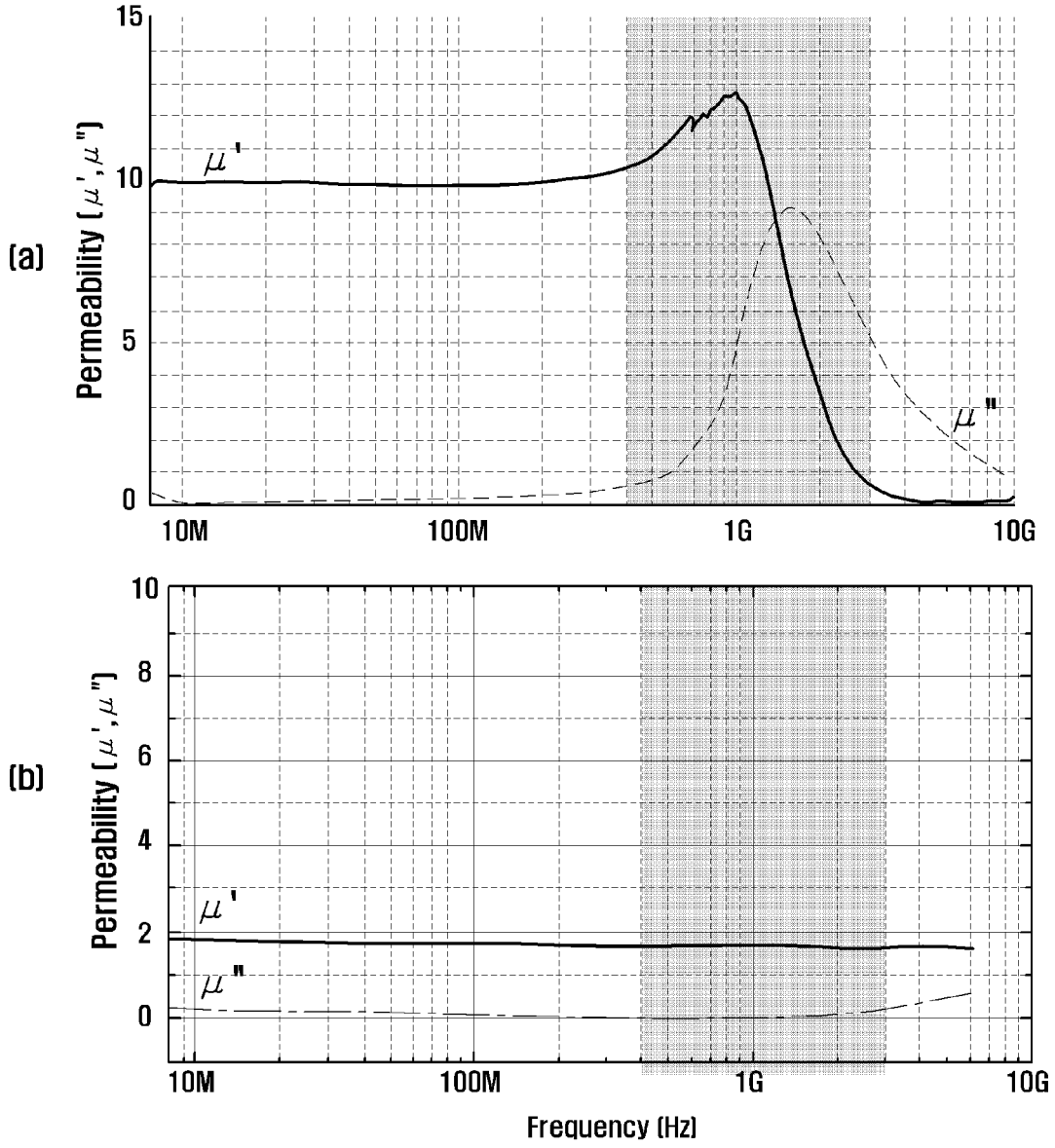
FIG. 2 is a graph illustrating an operating characteristic of the antenna apparatus of FIG. 1 according to an exemplary embodiment of the present invention.

FIG. 1 is a perspective view illustrating an antenna apparatus according to a first exemplary embodiment of the present invention, and FIG. 2 is a graph illustrating an operating characteristic of the antenna apparatus of FIG. 1 according to an exemplary embodiment of the present invention.

In the present exemplary embodiment, it is assumed that the antenna apparatus is formed as a Printed Circuit Board (PCB).

Referring to FIG. 1, an antenna apparatus 100 includes a board body 110, a ground plate 120, a device carrier 130, and an antenna device 140.

The board body 110 is provided for supporting the antenna apparatus 100. The board body 110 has a flat plate structure formed with at least four corners and is made of a dielectric substance. In an exemplary implementation, the board body 110 includes two or more dielectric plates. Further, a transmission line (not shown) is provided within the board body 110. Here, the transmission line is connected to an external power source (not shown) of the antenna apparatus 100 through one end portion. Further, the board body 110 is divided into a ground area 111 and a device region 113.

The ground plate 120 is provided for grounding the antenna apparatus 100. The ground plate 120 has a flat plate structure formed with at least four corners and is disposed at the ground area 111 of the board body 110. In an exemplary implementation, the ground plate 120 is formed to cover the ground area 111. Here, the ground plate 120 is formed on at least one of both surfaces of the board body 110. Further, when the board body 110 is formed with at least two dielectric plates, the ground plate 120 may be inserted between any two of the dielectric plates.

The device carrier 130 is provided to improve and sustain a performance of the antenna apparatus 100. The device carrier 130 has a flat panel structure with a predetermined thickness and is mounted in the device region 113 of the board body 110. Further, in an exemplary implementation, the device carrier 130 is formed with a magnetic carrier made of a Magneto-Dielectric (MD) material. As an example, the device carrier 130 may be formed with Y-type hexagonal ferrite.

In this case, the Y-type hexagonal ferrite is formed with base ferrite ($Ba_2Co_2Fe_{12}O_{22}$) and silicate glass. The Y-type hexagonal ferrite uses base ferrite as a major component, and silicate glass is added thereto. Here, in the Y-type hexagonal ferrite, the base ferrite is 100 WT %, and the silicate glass is 0.5 WT % to 5 WT %. The Y-type hexagonal ferrite has a density of $4.6\times10^3$ kg/m$^3$ or more and has a high strength characteristic.

The base ferrite is formed with iron oxide ($Fe_2O_3$), barium carbonate ($BaCO_3$), and cobalt oxide ($Co_3O_4$ or CoO). In this case, in base ferrite of 100 WT %, iron oxide is 59 WT % to 60 WT %, barium carbonate is 20 WT % to 20.5 WT %, and cobalt oxide is 20 WT % to 20.5 WT %.

The silicate glass is formed with at least one of silicon dioxide ($SiO_2$), boron oxide ($B_2O_3$), lithium oxide ($Li_2O$), potassium oxide ($K_2O$), sodium oxide ($Na_2O$), and barium oxide (BaO). In this case, in silicate glass of 100 WT %, silicon dioxide is 60 WT % to 100 WT %, boron oxide is 0 WT % to 20 WT %, lithium oxide is 0 WT % to 10 WT %, potassium oxide is 0 WT % to 5 WT %, sodium oxide is 0 WT % to 5 WT %, and barium oxide is 0 WT % to 5 WT %.

For example, in silicate glass of 100 WT %, silicon dioxide is 65 WT %, boron oxide is 20 WT %, lithium oxide is 7 WT %, potassium oxide is 5 WT %, and barium oxide is 3 WT %.

Alternatively, in silicon dioxide of 100 WT %, silicate glass may be one of silica glass and fumed silica glass. In this case, silicate glass is classified into silica glass or fumed silica glass according to a composition method or a specific surface area of particles. Here, silica glass is formed with particles of a micron (μ) size, and fumed silica glass is formed with particles of a nano (n) size.

A production procedure of Y-type hexagonal ferrite includes weighing components constituting Y-type hexagonal ferrite. Iron oxide, barium carbonate, and cobalt oxide are wet mixed. In this case, the iron oxide, barium carbonate, and cobalt oxide are ground into a powder and are mixed together with a solvent in a planetary mill through a high speed rotation of approximately 200 Revolution Per Minute (RPM). Here, the iron oxide, barium carbonate, and cobalt oxide are mixed for about 3 hours. Thereafter, the iron oxide, barium carbonate, and cobalt oxide are dried in an oven. In this case, by drying the iron oxide, barium carbonate, and cobalt oxide at a predetermined dry temperature, for example 120° C., a solvent is removed. Here, the iron oxide, barium carbonate, and cobalt oxide are dried for about 12 hours.

Next, the iron oxide, barium carbonate, and cobalt oxide are calcined into base ferrite. That is, the iron oxide, barium carbonate, and cobalt oxide are physically or chemically changed and, by removing impurities from the iron oxide, barium carbonate, and cobalt oxide, base ferrite is formed. In this case, the iron oxide, barium carbonate, and cobalt oxide are calcined by a solid state reaction method. The iron oxide, barium carbonate, and cobalt oxide are calcined at a predetermined calcination temperature, for example 1200° C. to 1300° C. Here, the iron oxide, barium carbonate, and cobalt oxide are calcined for about 2 hours. Thereafter, base ferrite is milled. In this case, silicate glass is added to the base ferrite. That is, the base ferrite and the silicate glass are ground into a powder and mixed through a high speed rotation of approximately 200 RPM in a planetary mill. Here, the base ferrite and the silicate glass are processed for about 3 hours.

Next, the base ferrite and the silicate glass are granulated. In this case, the base ferrite and the silicate glass are coupled using a binder. Here, the binder may be PolyVinyl Alcohol (PVA). Polyvinyl alcohol of 7 WT % is added based on total WT % of the base ferrite and the silicate glass. Further, the base ferrite and the silicate glass are pressed. That is, the base ferrite and the silicate glass are formed by controlling a density thereof. In this case, the base ferrite and the silicate glass are pressed with a pressure of 1 ton/cm$^2$ together with a binder. Thereafter, the binder of the base ferrite and the silicate glass is burned out. In this case, the binder is burned out from the base ferrite and the silicate glass at a predetermined burnout temperature, for example, 450° C. Here, the binder is burned out for about 4 hours.

Finally, the base ferrite and the silicate glass are sintered so that the base ferrite and the silicate glass more closely contact. For example, the base ferrite and the silicate glass closely contact at a density of $4.6\times10^3$ kg/m$^3$ or more. In this case, the base ferrite and the silicate glass are sintered at a predetermined sintering temperature. Here, the sintering temperature should be lower than the calcination temperature and should be 1000° C. to 1180° C. For example, the sintering temperature may be 1090° C. to 1110° C. Here, the base ferrite and the silicate glass are sintered for about 2 hours. Thereby, a production of Y-type hexagonal ferrite is complete.

The antenna device 140 is provided for resonance in the antenna apparatus 100. That is, the antenna device 140 transmits/receives a signal of a predetermined resonant frequency band. In this case, the antenna device 140 resonates in a predetermined reference impedance. The antenna device 140 is disposed at the device region 113 of the board body 110. In this case, the antenna device 140 is connected to the other end portion of a transmission line at a surface of the board body 110 through a feeding point 141 of one end portion. Here, the antenna device 140 is disposed adjacent to the ground plate 120 to position the feeding point 141. The antenna device 140 is extended in a predetermined form from the feeding point 141 to be located on a surface of the device carrier 130. Further, the antenna device 140 is formed with at least one conductive material, for example silver (Ag), palladium (Pd), platinum (Pt), copper (Cu), gold (Au), and nickel (Ni). Here, the antenna device 140 is formed through patterning, for example, printing, plating, deposition, and sputtering. In this case, the antenna device 140 is formed with a ground device 143 and a plurality of branch devices 147 and 149.

The ground device 143 is extended from the feeding point 141 to contact with the ground plate 120 through a short point 145 of the other end portion. Thereby, when operating in a resonant frequency band, the antenna device 140 is grounded by the ground plate 120. The ground device 143 is formed in a structure having at least one bent portion. Here, the ground device 143 is formed in at least one of a meander type, spiral type, step type, loop type, and the like.

The branch devices 147 and 149 are extended along each path from the feeding point 141 to be opened through the other end portion. The branch devices 147 and 149 are formed in a structure having at least one bonding portion. Here, the branch devices 147 and 149 are formed in at least one of a meander type, spiral type, step type, loop type, and the like. Thereby, when resonating in a resonant frequency band, the branch devices 147 and 149 operate at a frequency within a resonant frequency band. That is, the branch devices 147 and 149 operate in different frequency areas. Here, the branch devices 147 and 149 operate in a frequency area determined according to each size and form. For example, one of the branch devices operates in a relatively high frequency area of 1700 to 2500 MHz and the other one of the branch devices operates in a relatively low frequency area of 800 to 1000 MHz.

According to the present exemplary embodiment, when the antenna device 140 operates in a resonant frequency band, the device carrier 130 has a characteristic in which a loss factor tan $\delta_e$ by a permittivity $\in$ is 0.01 or less and a loss factor tan $\delta_m$ by a permeability $\mu$ is 0.1 or less. When the antenna device 140 operates in a resonant frequency band, the device carrier 130 has a characteristic in which a permittivity is 8 or less and a permeability is 1.5 or more. Here, in the resonant frequency band, a change ratio of a permittivity and a permeability of the device carrier 130 is sustained at 10% or less.

In this case, a resonant frequency band of the antenna apparatus 100 is 800 MHz to 2.5 Ghz. That is, the antenna apparatus 100 operates in a Global System for Mobile (GSM) communication band of 824 MHz to 894 MHz, an Extension of GSM (EGSM) communication band of 880 MHz to 960 MHz, a Digital Cordless System (DCS) communication band of 1710 MHz to 1880 MHz, a Personal Communication System (PCS) communication band of 1850 MHz to 1990 MHz, and a Wideband Code Division Multiple Access (WCDMA) communication band of 2000 MHz to 2500 MHz.

For example, in the antenna apparatus 100, when a length DL of the device region 113 is 45 mm, a width DW of the device region 113 is 10 mm, a length CL of the device carrier 130 is 40 mm, a width CW of the device carrier 130 is 5 mm, and a thickness CH of the device carrier 130 is 2 mm, the device carrier 130 obtains an operating characteristic as shown in FIG. 2. That is, when a permeability of the device carrier 130 exceeds 10 and a permittivity of the device carrier 130 is about 12, the device carrier 130 obtains a characteristic as shown in frame [a] of FIG. 2 to correspond to operating of the antenna device 140. In this case, in a frequency area of 400 MHz to 3 GHz, a permeability loss in the device carrier 130 increases. When a permeability of the device carrier 130 is 2 and a permittivity thereof is 6, the device carrier 130 has a characteristic, as shown in frame [b] of FIG. 2 to correspond to operating of the antenna device 140. In this case, in a frequency area 400 MHz to 3 GHz, linearity of a permeability loss in the device carrier 130 is sustained. Therefore, as the device carrier 130 is formed with a magnetic carrier made of a magneto-dielectric material according to an exemplary embodiment of the present invention, the device carrier 130 can easily sustain linearity of a loss to correspond to operation of the antenna device 140.

Further, as the device carrier 130 is formed with a magnetic carrier, a loss is reduced in the antenna apparatus 100, and an operating efficiency of the antenna apparatus 100 is improved. In this case, when the device carrier 130 is made of a magneto-dielectric material, an operating efficiency of the antenna apparatus 100 is shown in Table 1. In other words, the antenna apparatus 100 represents an operating efficiency of 45% or more in a plurality of frequency areas. Here, the antenna apparatus 100 represents an operating efficiency of 45% or more in frequency areas of 1 GHz or less and represents an operating efficiency of 50% or more in frequency areas of 1 GHz or more. That is, the antenna apparatus 100 can operate in a plurality of frequency areas and has a more extended resonant frequency band.

TABLE 1

| Frequency area (MHz) | Operating efficiency - mean value % | Operating efficiency - minimum value % |
|---|---|---|
| 850 | 48 | 31 |
| 900 | 50 | 38 |
| 1800 | 61 | 51 |
| 1900 | 76 | 65 |
| 2100 | 69 | 62 |

The foregoing exemplary embodiment illustrates an example in which an entire antenna device is formed at a surface of a device carrier. However, the present invention is not limited thereto. That is, a portion of the antenna device may be formed at a surface of the device carrier. Further, the foregoing exemplary embodiment illustrates an example in which an antenna device has a plurality of branch devices. However, the present invention is not limited thereto. That is, an antenna device having at least one branch device may be provided. As such an example, a second exemplary embodiment of the present invention is described below.

Figure 3:
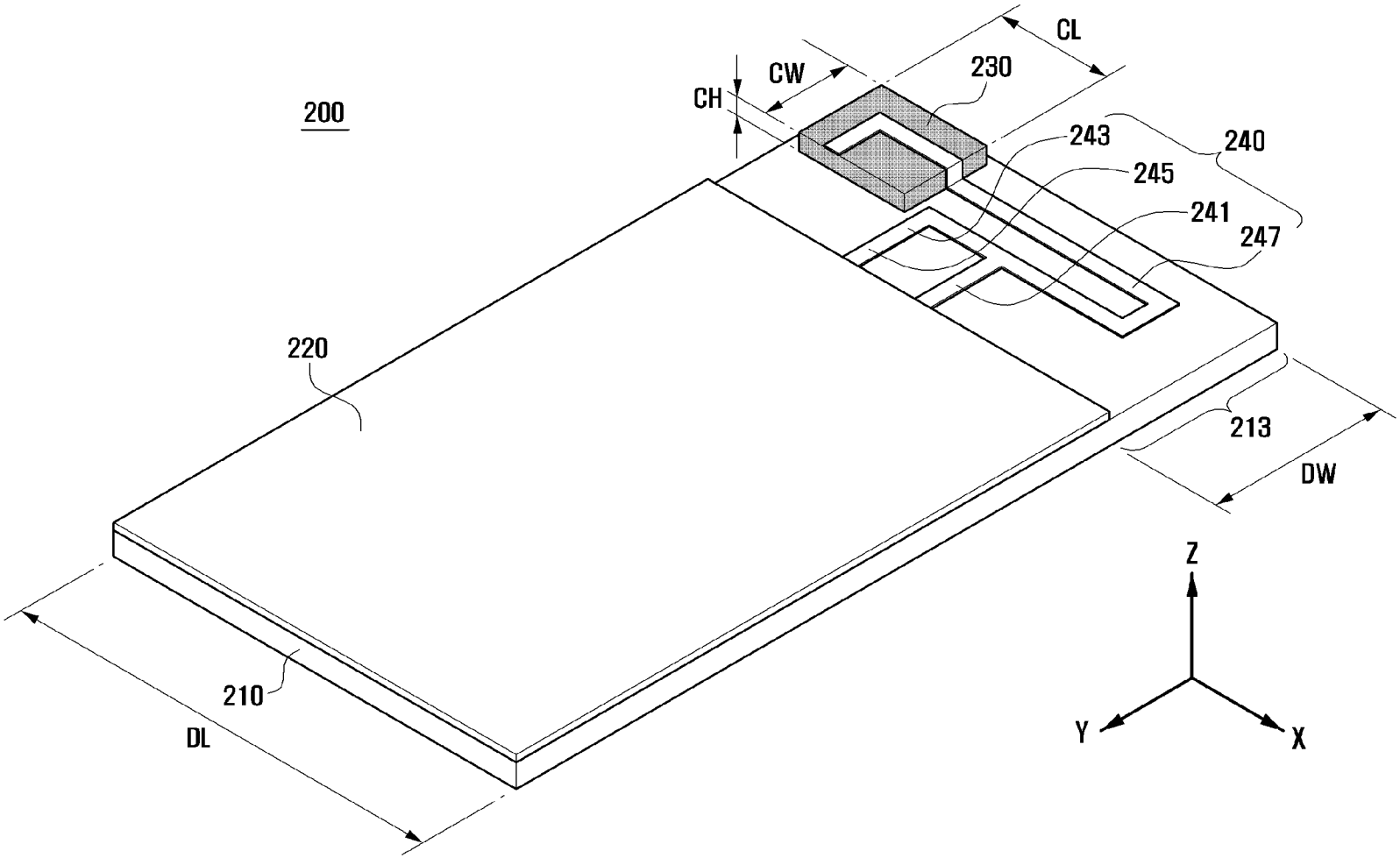
FIG. 3 is a perspective view illustrating an antenna apparatus according to a second exemplary embodiment of the present invention.
Figure 4:
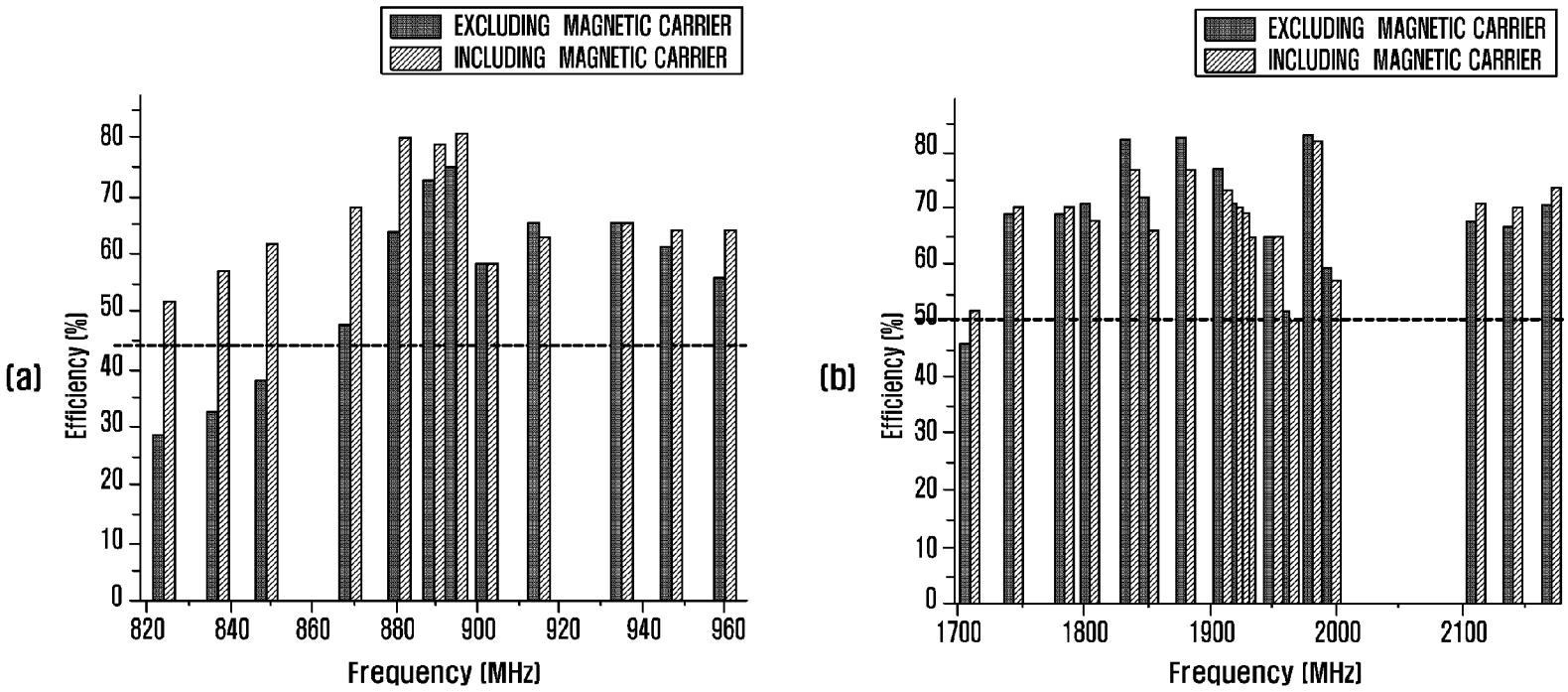
FIG. 4 is a graph illustrating an operating characteristic of the antenna apparatus of FIG. 3 according to an exemplary embodiment of the present invention.

FIG. 3 is a perspective view illustrating an antenna apparatus according to a second exemplary embodiment of the present invention, and FIG. 4 is a graph illustrating an operating characteristic of the antenna apparatus of FIG. 3 according to an exemplary embodiment of the present invention.

In the present exemplary embodiment, it is assumed that the antenna apparatus is formed as a PCB.

Referring to FIG. 3, an antenna apparatus 200 includes a board body 210, a ground plate 220, a device carrier 230, and an antenna device 240. In this case, a basic configuration of the board body 210, the ground plate 220, the device carrier 230, and the antenna device 240 is similar to that of the first exemplary embodiment and therefore a detailed description thereof is omitted.

As illustrated in FIG. 3, the device carrier 230 is mounted in an area in a device region 213 of the board body 210. That is, the device carrier 230 exposes the remaining area of the device region 213. In this case, in the present exemplary embodiment, the device carrier 230 is formed with a magnetic carrier made of a magneto-dielectric material. Here, the device carrier 230 may be formed with, for example, Y-type hexagonal ferrite.

Further, the antenna device 240 includes a ground device 243 and at least one branch device 247. In this case, the ground device 243 is extended from a feeding point 241 to a short point 245. Here, the ground device 243 may be formed in the remaining area of the device region 213. The branch device 247 is extended from the feeding point 241 to be opened through the other end portion. Here, the branch device 247 is formed in the remaining area of the device region 213 and a surface of the device carrier 230. That is, a portion of the branch device 247 passes through a surface of the device carrier 230. Thereby, when resonating in a resonant frequency band, the branch device 247 operates in at least two frequency areas. In this case, the branch device 247 operates in a frequency area determined according to a corresponding size and form. For example, the branch device 247 may operate in a relatively high frequency area of 1700 to 2500 MHz and in a relative low frequency area of 800 to 1000 MHz.

According to the present exemplary embodiment, when the antenna device 240 operates in a resonant frequency band, the device carrier 230 has a characteristic in which a loss factor by a permittivity is 0.01 or less and a loss factor by a permeability is 0.1 or less. When the antenna device 240 operates in a resonant frequency band, the device carrier 230 has a characteristic in which a permittivity is sustained to 8 or less and a permeability is sustained to 1.5 or more. Here, in the resonant frequency band, a change ratio of a permittivity and a permeability of the device carrier 230 is sustained at 10% or less.

In this case, a resonant frequency band of the antenna apparatus 200 may be 800 MHz to 2.5 GHz. That is, the antenna apparatus 200 operates in a GSM communication band of 824 MHz to 894 MHz, EGSM communication band of 880 MHz to 960 MHz, DCS communication band of 1710 MHz to 1880 MHz, PCS communication band of 1850 MHz to 1990 MHz, and WCDMA communication band of 2000 MHz to 2500 MHz.

For example, in the antenna apparatus 200, when the length DL of the device region 213 is 50 mm and the width DW thereof is 10 mm, and when the length CL of the device carrier 230 is 10 mm, the width CW thereof is 5 mm, and the thickness CH thereof is 2 mm, the antenna apparatus 200 represents an operating characteristic, as shown in FIG. 4. That is, in a relatively low frequency area of 800 to 1000 MHz within a resonant frequency band, an operating efficiency of the antenna apparatus 200 is represented as shown in frame [a] of FIG. 4 according to whether the device carrier 230 is included in the antenna apparatus 200. In a relatively high frequency area of 1700 to 2500 MHz within a resonant frequency band, an operating efficiency of the antenna apparatus 200 is represented as shown in frame [b] of FIG. 4 according to whether the device carrier 230 is included in the antenna apparatus 200. Here, the antenna apparatus 200 obtains an operating efficiency of 45% or more in frequency areas of 1 GHz or less and obtains an operating efficiency of 50% or more in frequency areas of 1 GHz or more.

That is, when the antenna apparatus 200 includes the device carrier 230, an operating efficiency of the antenna apparatus 200 is remarkably improved, compared with when the antenna apparatus 200 does not include the device carrier 230. More particularly, in a relatively low frequency area of 800 to 1000 MHz within a resonant frequency band, an operating efficiency of the antenna apparatus 200 is remarkably improved. In other words, the antenna apparatus 200 can operate in a plurality of frequency areas and has a more extended resonant frequency band.

The foregoing exemplary embodiments illustrate an example in which a device carrier is entirely formed with a magnetic carrier. However, the present invention is not limited thereto. That is, the present invention includes exemplary embodiments in which at least a portion of a device carrier is formed with a magnetic carrier. Further, the foregoing exemplary embodiments illustrate an example in which the antenna device includes a ground device and at least one branch device, and the ground device and the branch device are branched to be extended to each path. However, the present invention is not limited thereto. That is, the present invention includes exemplary embodiments in which a ground device and a branch device are integrally formed in the antenna device. As such an example, a third exemplary embodiment and a fourth exemplary embodiment according to the present invention are described.

Figure 5:
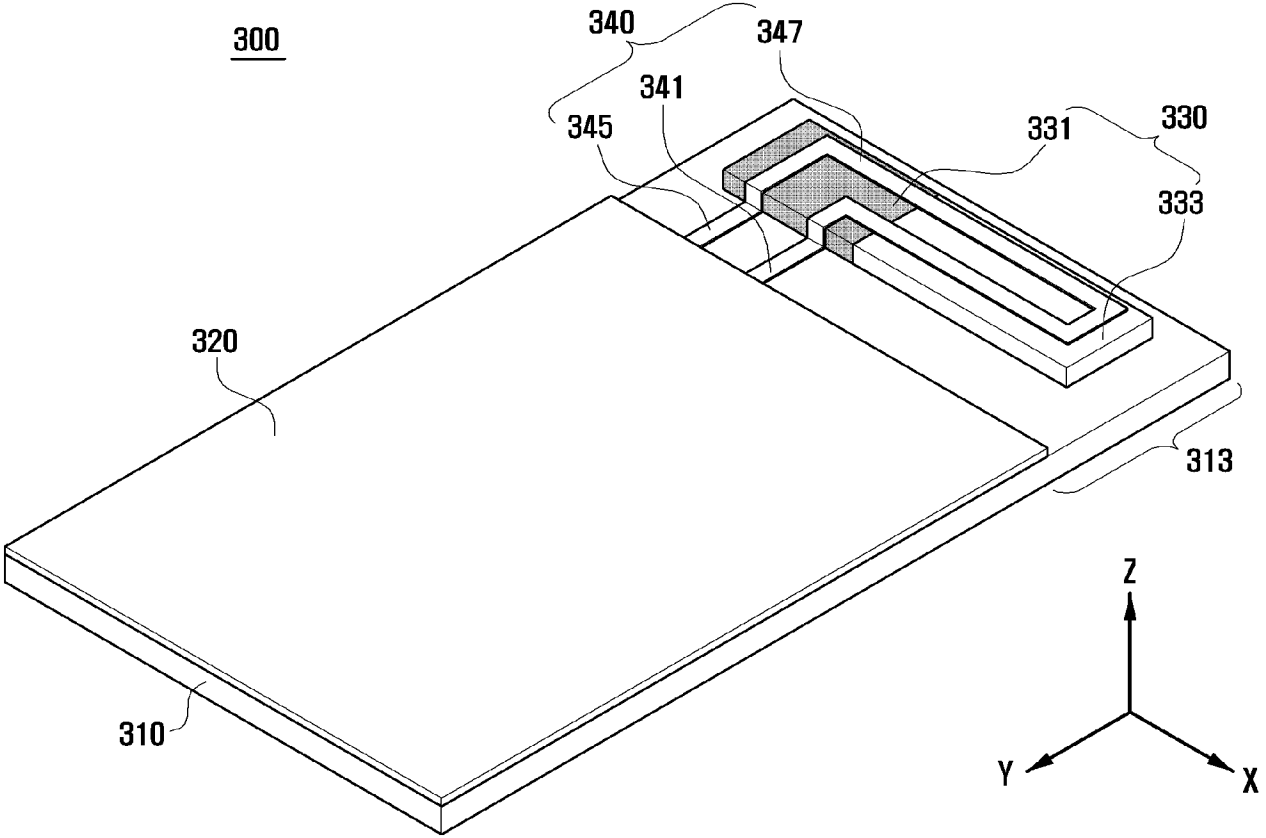
FIG. 5 is a perspective view illustrating an antenna apparatus according to a third exemplary embodiment of the present invention.

FIG. 5 is a perspective view illustrating an antenna apparatus according to a third exemplary embodiment of the present invention.

In the present exemplary embodiment, it is assumed that the antenna apparatus is formed as a PCB.

Referring to FIG. 5, an antenna apparatus 300 includes a board body 310, ground plate 320, device carrier 330, and antenna device 340. In this case, a basic configuration of the board body 310, the ground plate 320, the device carrier 330, and the antenna device 340 is similar to that of the foregoing exemplary embodiment and therefore a detailed description thereof is omitted.

As illustrated in FIG. 5, the device carrier 330 includes a magnetic carrier 331 made of a magneto-dielectric material and a dielectric carrier 333 made of a dielectric substance. Here, the magnetic carrier 331 is formed with, for example, Y-type hexagonal ferrite. The dielectric carrier 333 is formed with plastic or ceramic. In this case, in the device carrier 330, the magnetic carrier 331 is physically coupled to the dielectric carrier 333 through one side portion. Further, the magnetic carrier 331 and the dielectric carrier 333 are mounted in a device region 313 of the board body 310. Here, the magnetic carrier 331 may be formed having a size different from that of the dielectric carrier 333. That is, the magnetic carrier 331 may have different areas from that of the dielectric carrier 333 and have different thicknesses from that of the dielectric carrier 333.

Further, the antenna device 340 is extended from a feeding point 341 of one end portion to be formed in a surface of the device carrier 330. In this case, a portion of the antenna device 340 is formed on a surface of the magnetic carrier 331, and the remaining portions are formed on the surface of the dielectric carrier 333. The antenna device 340 contacts with the ground plate 320 through a short point 345 of the other end portion. That is, the antenna device 340 is formed with a connection element 347 for connecting with the feeding point 341 and the short point 345. Here, the connection element 347 operates similarly to a ground device and a branch device of the foregoing exemplary embodiments. Thereby, the antenna apparatus 300 operates in a more extended resonant frequency band.

According to the present exemplary embodiment, when the antenna device 340 operates in a resonant frequency band, the device carrier 330 has a characteristic in which a loss factor by a permittivity is 0.01 or less and a loss factor by a permeability is 0.1 or less. When the antenna device 340 operates in a resonant frequency band, the device carrier 330 has a characteristic in which a permittivity is sustained to 8 or less and a permeability is sustained to 1.5 or more. Here, in the resonant frequency band, a change ratio of a permittivity and a permeability of the device carrier 330 is sustained at 10% or less.

Figure 6:
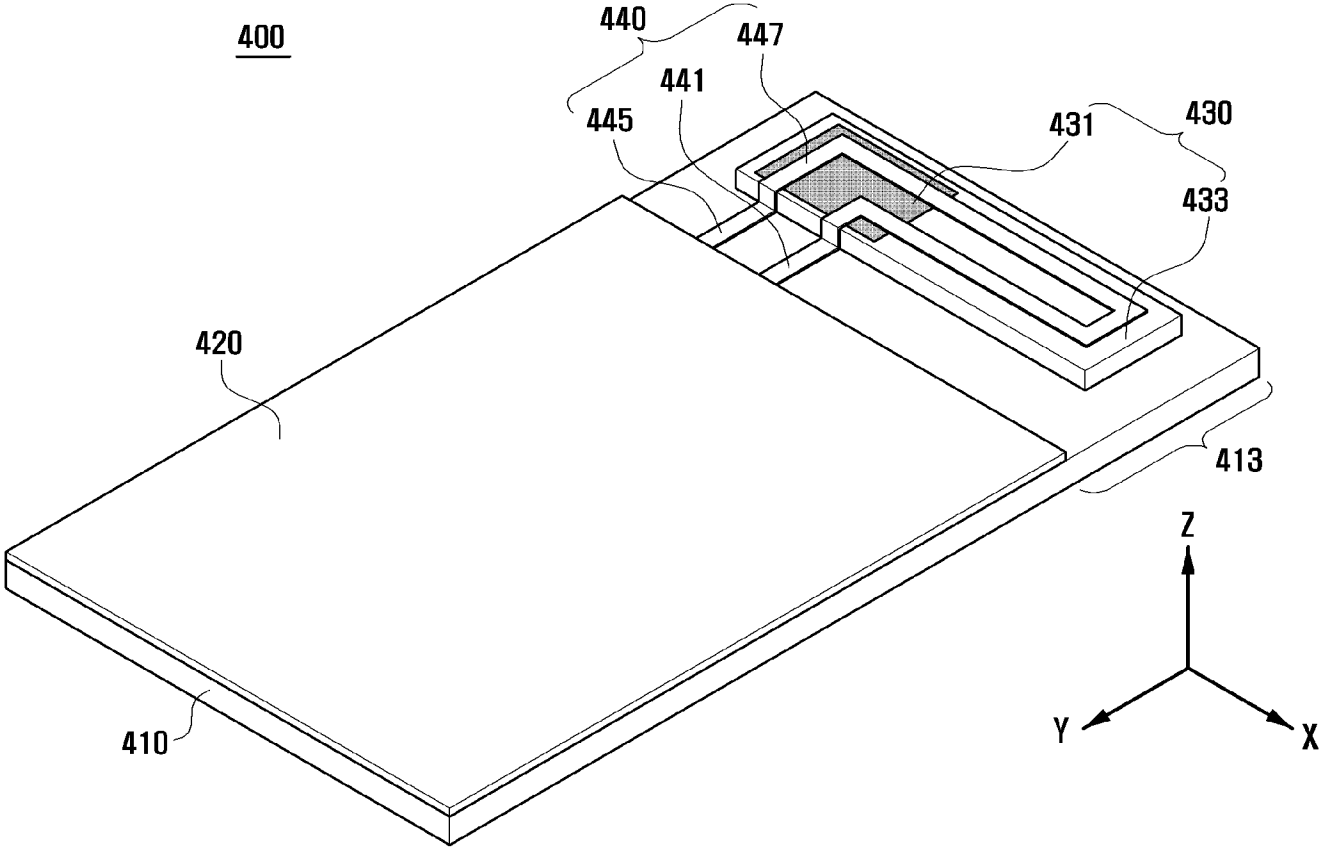
FIG. 6 is a perspective view illustrating an antenna apparatus according to a fourth exemplary embodiment of the present invention.
Figure 7:
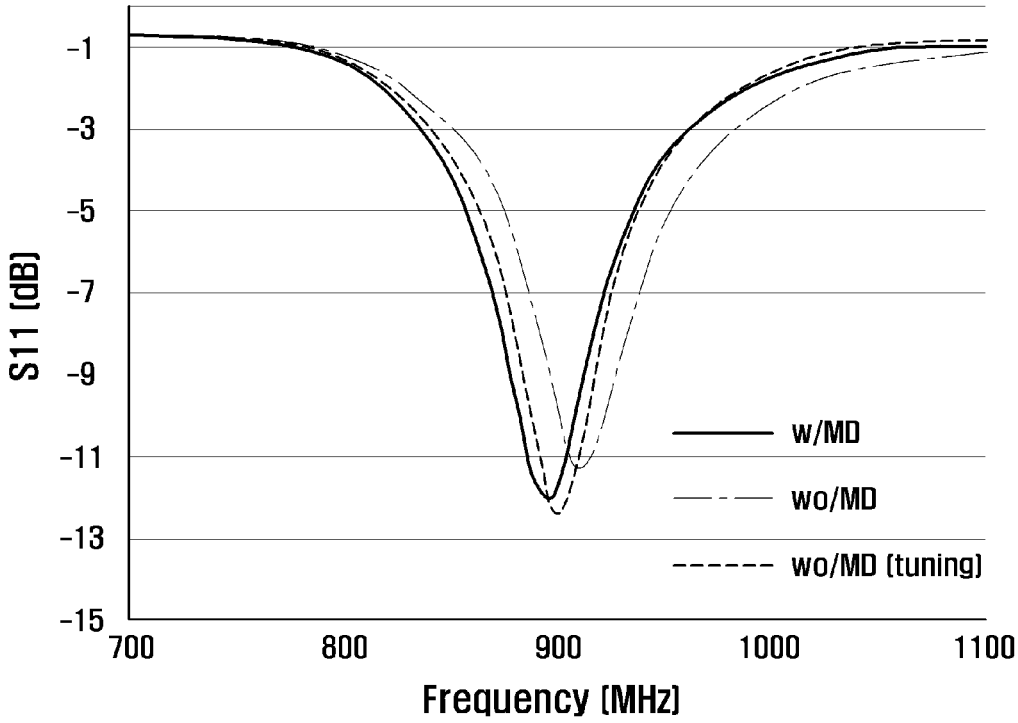
FIG. 7 is a graph illustrating an operating characteristic of the antenna apparatus of FIG. 6 according to an exemplary embodiment of the present invention.

FIG. 6 is a perspective view illustrating an antenna apparatus according to a fourth exemplary embodiment of the present invention, and FIG. 7 is a graph illustrating an operating characteristic of the antenna apparatus of FIG. 6 according to a fourth exemplary embodiment of the present invention.

In the present exemplary embodiment, it is assumed that the antenna apparatus is formed as a PCB.

Referring to FIG. 6, an antenna apparatus 400 includes a board body 410, ground plate 420, device carrier 430, and antenna device 440. In this case, a basic configuration of the board body 410, the ground plate 420, the device carrier 430, and the antenna device 440 is similar to that of the foregoing exemplary embodiment and therefore a detailed description thereof is omitted.

As illustrated in FIG. 6, the device carrier 430 includes a magnetic carrier 431 made of a magneto-dielectric material and a dielectric carrier 433 made of a dielectric substance. Here, the magnetic carrier 431 is formed with, for example, Y-type hexagonal ferrite. The dielectric carrier 433 is made of plastic or ceramic. In this case, in the device carrier 430, the magnetic carrier 431 is physically inserted into or located on top of the dielectric carrier 433. That is, as the dielectric carrier 433 is disposed at a circumferential area of the magnetic carrier 431, the magnetic carrier 431 is physically coupled to the dielectric carrier 433. Further, the magnetic carrier 431 and the dielectric carrier 433 are mounted in a device region 413 of the board body 410. Here, the magnetic carrier 431 may be formed having different sizes from that of the dielectric carrier 433. That is, the magnetic carrier 431 may have different areas from that of the dielectric carrier 433 and have different thicknesses from that of the dielectric carrier 433.

Further, the antenna device 440 is extended from a feeding point 441 of one end portion to be formed at the surface of the device carrier 430. In this case, a portion of the antenna device 440 passes through a surface of the magnetic carrier 431, and the remaining portions are formed at a surface of the dielectric carrier 433. The antenna device 440 contacts with the ground plate 420 through a short point 445 of the other end portion. That is, the antenna device 440 includes a connection element 447 for connecting the feeding point 441 and the short point 445. Here, the connection element 447 operates similarly to the ground device and the branch device of the foregoing exemplary embodiments.

Thereby, the antenna apparatus 400 operates in a more extended resonant frequency band, as shown in FIG. 7. That is, when the device carrier 430 does not include the magnetic carrier 431 and is entirely formed with the dielectric carrier 433, a resonant frequency band of the antenna apparatus 400 to an entire frequency band is 12.06%. However, as the device carrier 430 includes the magnetic carrier 431, a resonant frequency band of the antenna apparatus 400 to an entire frequency band is extended to 14.03%.

According to the present exemplary embodiment, when the antenna device 440 operates in a resonant frequency band, the device carrier 430 has a characteristic in which a loss factor by a permittivity is 0.01 or less and a loss factor by a permeability is 0.1 or less. When the antenna device 440 operates in a resonant frequency band, the device carrier 430 has a characteristic in which a permittivity is sustained to 8 or less and a permeability is sustained to 1.5 or more. Here, in the resonant frequency band, a change ratio of a permittivity and a permeability of the device carrier 430 is sustained at 10% or less.

Further, the antenna apparatus 400 represents an operating efficiency as illustrated in Table 2 according to whether the magnetic carrier 431 is included in the device carrier 430. In this case, as the antenna apparatus 400 includes the magnetic carrier 431, the antenna apparatus 400 has a remarkably improved operating efficiency, compared with a case where the antenna apparatus 400 does not include the magnetic carrier 431. Here, Total Radiated Power (TRP) represents a transmission performance of the antenna apparatus 400, and Total Isotropic Sensitivity (TIS) represents a reception performance of the antenna apparatus 400. TRP and TIS represent a performance corresponding to an absolute value.

TABLE 2

| Frequency area (MHz) | Division | TRP | TIS |
|---|---|---|---|
| 850 | excluding magnetic carrier | 24.5 | −104.0 |
| | including magnetic carrier | 25.0 | −104.7 |
| 900 | excluding magnetic carrier | 25.7 | −101.5 |
| | including magnetic carrier | 26.6 | −103.0 |
| 1800 | excluding magnetic carrier | 26.1 | −105.6 |
| | including magnetic carrier | 27.4 | −105.4 |
| 1900 | excluding magnetic carrier | 25.3 | −102.5 |
| | including magnetic carrier | 24.6 | −101.8 |

The foregoing exemplary embodiments illustrate a case where the antenna apparatus is formed as a PCB. However, the present invention is not limited thereto. That is, the present invention includes exemplary embodiments in which a device carrier and an antenna device are directly mounted in a case of a communication terminal for mounting the antenna apparatus. In this case, in the antenna apparatus, the board body and the ground plate may be unnecessary.

According to exemplary embodiments of the present invention, as at least a portion of the device carrier is formed with a magnetic carrier, an operating performance of the antenna apparatus can be improved. Thereby, as at least a portion of the device carrier is formed with a magnetic carrier, the device carrier can be formed having a smaller size, compared with a case where the device carrier is entirely formed with a dielectric carrier. That is, even if a size of the device carrier is reduced, the antenna apparatus may represent at least similar operating performance to a case where the device carrier is entirely formed with a dielectric carrier.

Thereby, the antenna apparatus can be formed having a small size. In this case, the antenna apparatus may have an electrical length of $\lambda/2$ for a wavelength $\lambda$ corresponding to a resonant frequency band. Here, the wavelength $\lambda$ is calculated by Equation 1. That is, as at least a portion of the device carrier is formed with a magnetic carrier, a ratio of a permittivity and a permeability of the device carrier changes and thus an electrical length of the antenna apparatus can be reduced.

Further, a resonant frequency band of the antenna apparatus can be extended. In this case, a resonant frequency band of the antenna apparatus is determined by Equation 2. That is, as the device carrier is formed with a magnetic carrier, a ratio of a permittivity and a permeability of the device carrier changes and thus a resonant frequency band of the antenna apparatus can be extended.

$$\lambda = \frac{\lambda_o}{\sqrt{\varepsilon_r \mu_r}} \quad \text{Equation 1}$$

$$BW = \sqrt{\frac{\mu_r}{\varepsilon_r}} \frac{96(t/\lambda_0)}{\sqrt{2}\,(4 + 17\sqrt{\mu_r \varepsilon_r})} \quad \text{Equation 2}$$

where $\lambda$ represents a wavelength in a material, $\lambda_0$ represents a wavelength of vacuum, $\in_r$ represents a relative permittivity, i.e., a ratio of a permittivity of a material to a permittivity of vacuum, $\mu_r$ represents a relative permeability, i.e., a ratio of a permeability of a material to a permeability of vacuum, and BW represents a resonant frequency band. The material may correspond to a device carrier.

Therefore, in an antenna apparatus having a device carrier made of a magneto-dielectric material according to exemplary embodiments of the present invention, by forming at least a portion of the device carrier with a magnetic carrier, an operating performance can be improved. Thereby, as at least a portion of a device carrier is formed with a magnetic carrier, the device carrier can be formed having a smaller size, compared with a case where a device carrier is entirely formed with a dielectric carrier. That is, even if a size of the device carrier is reduced, the antenna apparatus can represent at least similar operating performance to that of a case where a device carrier is entirely formed with a dielectric carrier.

Accordingly, the antenna apparatus can be formed having a small size. Further, a resonant frequency band of the antenna apparatus can be extended. That is, as a device carrier is formed with a magnetic carrier, a ratio of a permittivity and a permeability of the device carrier changes and thus an electrical length of the antenna apparatus can be reduced and a resonant frequency band can be extended.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An antenna apparatus comprising:

a device carrier having a magnetic carrier made of a magneto-dielectric material; and an antenna device connectable to a power source through a feeding point of one end portion and extended from the feeding point to pass through a surface of the magnetic carrier and operable in a resonant frequency band when power is supplied through the feeding point, wherein the device carrier further comprises a dielectric carrier made of a dielectric substance and physically coupled to the magnetic carrier.

2. The antenna apparatus of claim 1, wherein the antenna device is branched from the feeding point to be extended along a plurality of paths and comprises at least two branch lines operating in different frequency bands within the resonant frequency band when power is supplied through the feeding point.

3. The antenna apparatus of claim 1, wherein, in the resonant frequency band of the magnetic carrier, a loss factor by a permittivity is 0.01 or less, a loss factor by a permeability is 0.1 or less, the permittivity is 8 or less, and the permeability 1.5 or more.

4. The antenna apparatus of claim 1, wherein the magnetic carrier comprises:

a base ferrite comprising iron oxide, barium carbonate, and cobalt oxide; and a silicate glass added to the base ferrite.

5. The antenna apparatus of claim 4, wherein the base ferrite comprises a Y-type hexagonal ferrite.

6. The antenna apparatus of claim 5, wherein the magnetic carrier comprises the base ferrite at 100 WT %, and the silicate glass at 0.5 WT % to 5 WT % and further wherein the ferrite has a density of $4.6\times10^3$ kg/m$^3$ or more.

7. The antenna apparatus of claim 1, wherein, in the device carrier, the magnetic carrier is inserted into the dielectric carrier, and the dielectric carrier is disposed at a circumferential area of the magnetic carrier.

8. The antenna apparatus of claim 1, wherein the dielectric carrier comprises a ceramic material.

9. The antenna apparatus of claim 1, wherein the antenna device is opened through another end portion opposite to the one end portion.

10. The antenna apparatus of claim 1, wherein the antenna device is extended at a surface of the device carrier.

11. The antenna apparatus of claim 10, further comprising a board body that mounts the device carrier, the board body having a ground plate separated from the device carrier for grounding the antenna device.

12. The antenna apparatus of claim 11, wherein the antenna device is extended from a surface of the board body.

13. The antenna apparatus of claim 11, wherein the antenna device electrically contacts the ground plate through another end portion opposite to the one end portion.

14. A method of making an antenna apparatus, the method comprising:

forming a device carrier having a magnetic carrier made of a magneto-dielectric material; and forming an antenna device connectable to a power source through a feeding point of one end portion and extended from the feeding point to pass through a surface of the magnetic carrier and operable in a resonant frequency band when power is supplied through the feeding point, wherein the device carrier further comprises a dielectric carrier made of a dielectric substance and physically coupled to the magnetic carrier.

15. The method of claim 14, wherein the forming of the magnetic carrier comprises:

forming a base ferrite by mixing iron oxide, barium carbonate, and cobalt oxide; and adding a silicate glass to the base ferrite.

16. The method of claim 15, wherein the forming of the base ferrite comprises forming a Y-type hexagonal ferrite.

17. The method of claim 16, wherein the forming of the magnetic carrier comprises forming the base ferrite at 100 WT %, and forming the silicate glass at 0.5 WT % to 5 WT % such that the ferrite has a density of $4.6\times10^3$ kg/m$^3$ or more.

* * * * *